US005158291A

United States Patent [19]

Biagi et al.

[11] Patent Number: 5,158,291

[45] Date of Patent: Oct. 27, 1992

[54] BALL ACCELERATOR FOR ROLLING BALL GAMES

[75] Inventors: Carl Biagi; Charles R. Bleich; Manu Jayswal; Walter E. Smolucha, all of Chicago, Ill.

[73] Assignee: William ELectronics Games, Inc., Chicago, Ill.

[21] Appl. No.: 823,703

[22] Filed: Jan. 21, 1992

[51] Int. Cl.[5] ..... A63D 3/00; A63F 7/00

[52] U.S. Cl. ..... 273/118 A; 273/119 A; 273/123 A; 273/127 R

[58] Field of Search ..... 273/118 R, 118 A, 119 R, 273/119 A, 120 A, 121 A, 121 D, 122 A, 123 A, 124 A, 125 A, 127 R, 127 C, 129 R, 129 S, 129 V, 456; 124/3

[56] References Cited

U.S. PATENT DOCUMENTS 1,885,662 11/1932 Whitehorn ..... 273/119 A
2,184,867 12/1939 Williams et al. ..... 273/119 A
2,780,462 2/1957 Casamada et al. ..... 273/119 A
4,373,725 2/1983 Ritchie ..... 273/121 A
4,991,845 2/1991 Wies ..... 273/121 A

*Primary Examiner*—V. Millin
*Assistant Examiner*—Jessica J. Harrison
*Attorney, Agent, or Firm*—Rockey, Rifkin and Ryther

[57] ABSTRACT

A ball accelerator mechanism employs one or more electromagnetic coils in combination with sensor elements to accelerate a rolling ball made of ferro-magnetic material. As a ball approaches the coil, it operates the sensor applying a DC current pulse to the coil. As the ball enters the coil, it is magnetically accelerated until it clears the sensor at which time the current is turned off. The length of the current pulse is thus a function of ball velocity. Preferably to maximize acceleration, the width of the coil is an integral multiple of the ball diameter.

13 Claims, 4 Drawing Sheets

BALL ACCELERATOR FOR ROLLING BALL GAMES

BACKGROUND OF THE INVENTION

The invention relates to coin-operated amusement devices which employ rolling balls to activate switches on a playfield. Such games include the familiar pinball game, novelty games such as baseball type games and the like. While such games have been around for many years, in order to stimulate and maintain player interest, it is necessary constantly to revise and improve the playfield features with which the rolling ball interacts. These include ramps, outholes, drop targets and the like.

Regardless of the type of playfield feature, if the motion of the ball is stopped for purposes of the game, it is necessary to put the ball back into play. Traditionally, this has been accomplished through the use of ball ejectors which are merely solenoids positioned on or under the playfield in a manner so as to strike the pinball and thereby to free it from a hole or release it from a confined area. Although these electro-mechanical devices are satisfactory for their intended purpose, it is desirable to provide an improved means to propel the ball on the playfield. The improvement can be both in terms of improved reliability, by the elimination of mechanical parts, and in the sense of improved player appeal.

The present invention achieves both objectives and therefore, is a highly desirable addition to the rolling ball game art. The present invention is capable of providing the function of a typical ball ejector and doing so with no mechanical parts which tend to wear out. In addition, it has a myriad of applications as a playfield feature, which add player interest and therefore popularity to a particular game. Specifically, according to one embodiment of the invention, it is possible to provide a ball accelerator which can cause a pinball to be accelerated to a high velocity while traveling on a confined track.

It is accordingly an object of the present invention to provide an improved ball ejector device for freeing a rolling ball from a confined area on a playfield.

It is a further object of the invention to provide a ball accelerator device which can accelerate a rolling ball on a playfield to create added player interest.

Another object of the invention is to provide a device of the aforementoned type which has no moving parts which physically interacts with the pinball, thereby to improve the reliability of the device.

These and other objects of the invention will be apparent from the remaining portion of the specification.

DETAILED DESCRIPTION

Figure 1:
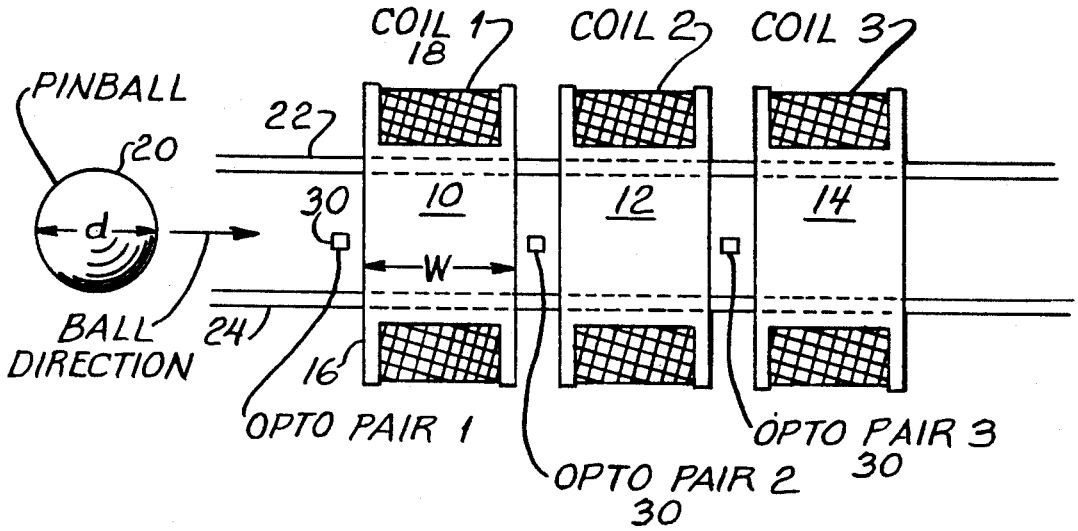
FIG. 1 is a plan view of a first embodiment of the invention in which a ball accelerator is constructed from a series of three coils.

Referring to FIG. 1 a plan view of a ball accelerator according to one embodiment of the invention is illustrated. For illustrative purposes, the accelerator includes three coils, 10, 12 and 14. It will be recognized, however, that a greater or fewer number of coils may be used depending upon the amount of acceleration desired, the size of the ball and the particular orientation of the coils (horizontally or vertically disposed). The coils are arranged in line and, preferably, are of a type employing a nylon core 16 around which is wound a number of turns of electrically conductive wire 18. The core has an opening such that a rolling ball can pass therethrough. Alternately, the coil may be formed on a mandrel or other winding equipment without a core.

In either event, a ball 20 having a diameter d is guided on a wire form, ramp or other device as indicated at 22, 24 toward the coils 10, 12 and 14. Upon reaching the coils, it passes through the open portion of each.

According to the present invention sensor elements 30 are disposed along the path defined by guides 22 and 24, at a position just in front of each coil. The sensor elements are employed to detect the proximity of the ball 20 prior to its entrance into each of the coils. The sensors can be of any available type such as an optical semi-conductors, Hall effect detectors, eddy current devices, magnetic or capacitive switch elements. According to a preferred embodiment of the invention, the sensor elements 30 are optical semi-conductor pairs such as an LED and photo-transistor arranged such that the ball interrupts the light path between the two elements thereby signaling its presence at the coil. Further details concerning the sensor element are provided in connection with the description of FIG. 6.

As is apparent from FIG. 1 the accelerator receives the ball 20 which passes through each of coils 10, 12 and 14 in sequence. When the ball reaches the first sensor 30, a signal is generated which causes a DC current to be applied to coil 10. Subsequently, the ball enters the core 16 and eventually no longer interrupts the sensor 30. This produces another signal (in digital logic a signal of opposite plurality) indicating that the ball has entered the coil. At this time the DC current to the coil 10 is discontinued. In effect, the coil is pulsed with a DC current, preferably supplied from a 50 volt DC power supply, from a time just prior to the ball entering the coil until the ball is within the coil. The importance of this arrangement will be explained presently.

The ball has a diameter d while the coil has a width w. In order to maximize the acceleration on the ball, it is important that the coil be energized immediately prior to the ball entering the core. The ball will then be accelerated by the magnetic field so created through the first portion of the coil. If the DC current remains on after the ball has reached the midpoint of the coil, the field will have an opposite, and undesired, effect on the ball, namely it will cause it to decelerate. Accordingly, it is desired to terminate current to the coil not later than when the center of mass of the ball reaches the mid-point of the coil.

A complicating factor arises from the fact that the speed of the ball is unknown and will vary considerably depending upon the circumstances of game play. Thus, for example, a ball directly propelled at a coil by the player operated flippers may be traveling at a high rate of speed. Another ball, which for example, ricochets off an intermediate playfield feature, may be moving very slowing as it enters the accelerator. For the accelerator of this embodiment to operate properly, a scheme is required whereby proper pulsing of the current to the coils is obtained, regardless of the initial velocity of the ball.

This is accomplished, according to the present invention, by the use of the sensor elements 30 at the entrance to each of the coils for controlling the duration of the current pulse applied to each coil. Thus, each coil is turned on when a ball is detected at its entrance and off as soon as the ball has cleared the sensor and is contained within the coil. In order to maximize the acceleration effect, the coils should be of a width w equal to an integral multiple (preferably 1× or 2×) the ball diameter. In this way, it can be assured that each sensor will terminate the current pulse to a coil not later than the time when the center of mass of the ball reaches the half-way point in the coil.

Returning to the FIG. 1 embodiment when the ball 20 enters the first coil 10 it will be accelerated to a velocity higher than its internal velocity. It then passes to the second co and the third coil 14 achieving higher velocities as it exits each coil. In each case, the sensors will create current pulses of different durations. Since the ball will be traveling more quickly at coils 12 and 14 than at coil 10 the duration of the pulse applied to coil 12 will be shorter than a coil 10 and the pulse applied to coil 14 will be shorter still.

In summary, the present invention uses a sensor, such as an optical semi-conductor pair at the entrance to each coil for controlling the turn on and turn off of the coil. This produces a variable length current pulse applied to the coil, which is a function of the entrance velocity of the ball. Specifically, a fast ball receives a short pulse, while a slow ball receives a longer pulse. By utilizing coils having a width which is an integral of the ball diameter, maximum acceleration of the ball by each coil is thereby obtained by avoiding deceleration after the ball passes the half-way point in the coil.

Figure 2:
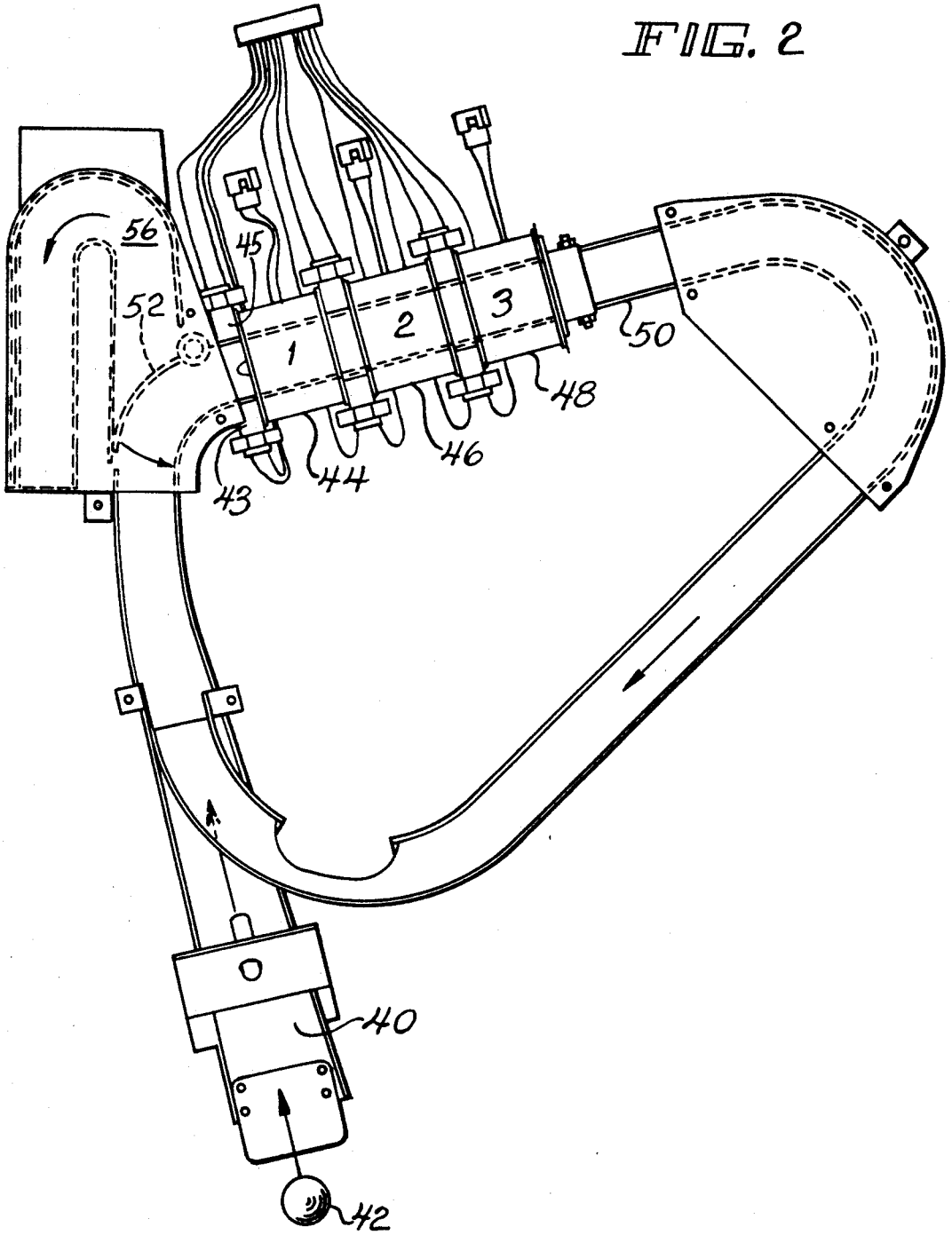
FIG. 2 is more detailed view of the FIG. 1 embodiment showing its application in a playfield feature as a ball accelerator.

Referring to FIG. 2, a specific embodiment of the ball accelerator of FIG. 1 to a playfield feature is illustrated. This device is intended as a playfield feature for a typical pinball game in which a plurality of targets, ramps and other devices are mounted on a playfield which is tilted slightly towards the player end. In the embodiment illustrated in FIG. 2, the playfield feature includes a ramp 40 at which a player attempts to direct a ball 42. If successful, the ball leaves the playfield, travels on the ramp to the entrance of a set of three accelerator coils 44, 46 and 48. As the ball travels on the ramp 40, it reaches the entrance to the first coil 44 where it interrupts the opto-pair 43, 45 causing a current pulse to be applied to the coil 44 thereby to accelerate the ball toward the coil 46. Similar actions occur at 46 and 48 causing the ball to exit onto a circuitous ramp portion 50 with sufficient velocity to travel on that ramp back to the entrance of the accelerator 44. In this way, a novel and exciting playfield feature is created in which a ball enters the ramp 40 and then is "trapped" on a high speed ramp for a selected period of time.

When it is desired to release the ball from this loop, a mechanical element including a diverter arm 52 shown in phantom, is rotated from its initial position by, for example a solenoid, in the direction of the arrow 54 thereby to close off the path to the accelerator and divert the ball to a further ramp portion 56 which may lead back to the playfield. The FIG. 2 playfield feature is merely one example of a class of playfield features which can be designed using ramps and the accelerator device according to the present invention. Other examples include ball launchers, ball cannons, lock up ejectors and the devices described hereafter.

Figure 3:
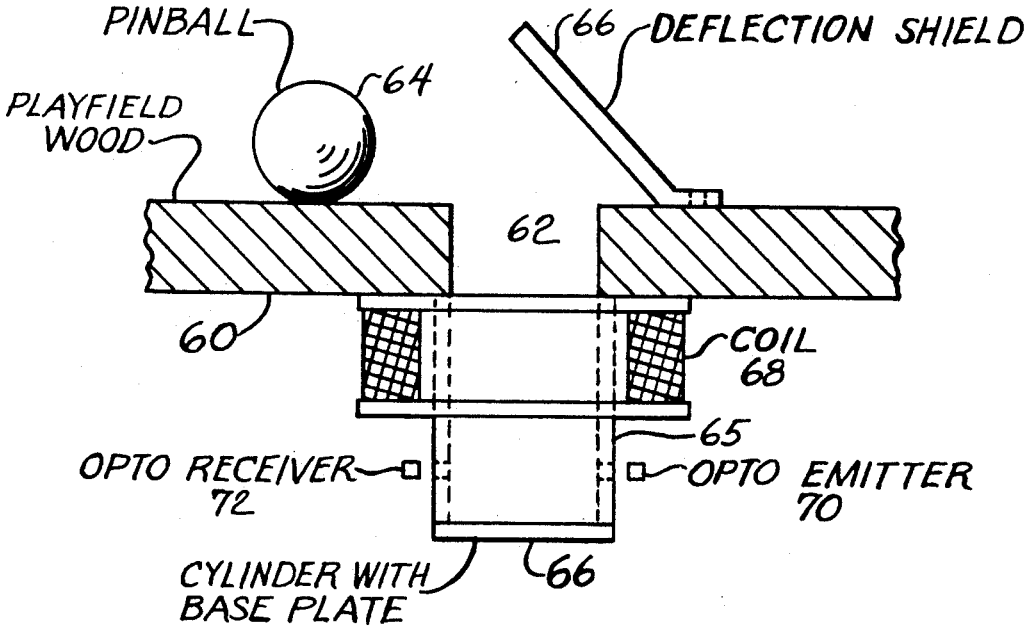
FIG. 3 is a side sectional view of a second embodiment of the invention comprising a ball ejector.

Referring now to FIG. 3 another important application of the present invention is illustrated. It is typical in rolling ball games to have holes in the playfield into which the ball can fall. After scoring this occurrence, it is desired to eject the ball from the hole. As indicated in the background portion of the specification, this has traditionally been accomplished using electro-mechanical devices such as solenoids arranged so that the solenoid plunger strikes the ball to eject it from the hole. These devices, in time, require adjustment, servicing or replacement because of the wear of parts from impact with the ball. In the FIG. 3 embodiment, a ball ejector is illustrated in which no mechanical parts touch the pinball. Instead, the ball accelerator concept of the present invention is utilized to eject the ball from the hole.

More specifically, a playfield 60 has an opening 62 therein of a diameter sufficient to permit a pinball 64 to be received therein. It is typical in such applications to provide a deflector shield 66 adjacent the opening to assist the ball, both upon entering and exiting the opening. The hole in the playfield is covered therebeneath by a hollow cylinder 65 closed at its bottom end by a base plate 66.

According to the present invention, a coil 68 of the type described in connection with FIG. 1 is concentrically disposed about the cylinder 65 at approximately the upper portion thereof. A sensor element such as an optical semi-conductor pair 70, 72 is disposed below the coil. As will be apparent, when the ball enters the hole 62, it drops to the bottom of the cylinder and rests on the base plate 66. This is detected by the optical pair 70, 72, which information is transmitted to the game computer in a conventional manner for example via a switch matrix. After scoring or other appropriate action, the ball is then ejected from the hole by activating the coil 68 for a period of time until the ball clears the sensors 70, 72. The magnetic force on the ball from the coil propels the ball upwardly until it contacts the deflector shield 66 causing it to roll onto the playfield.

Figure 4:
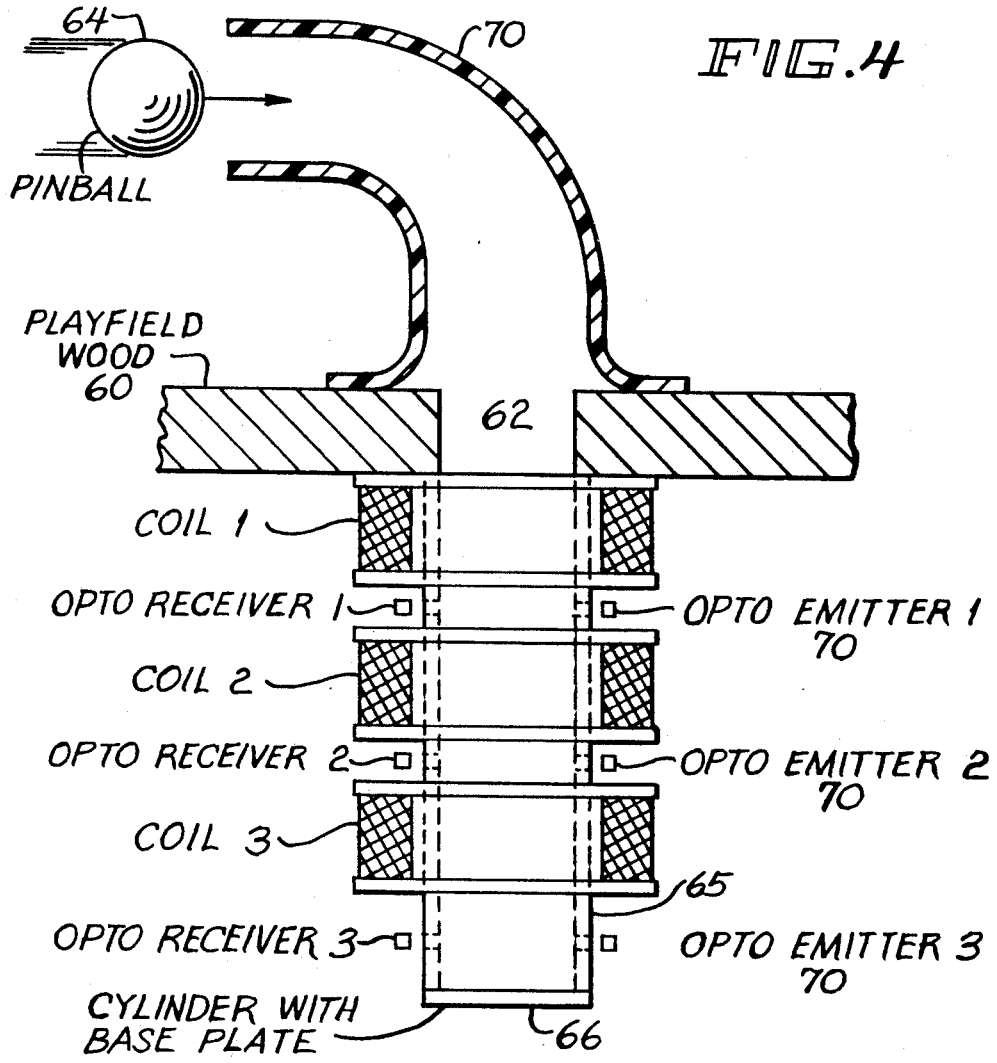
FIG. 4 illustrates a third embodiment of the invention in a side sectional view comprising a ball popper for elevating the pinball above the surface of the playfield.

Referring to FIG. 4, a further embodiment of the invention is shown in which the accelerator feature is used as a ball popper. Like the FIG. 3 embodiment, the playfield has a hole into which the ball may pass and the hole is covered from the underside of the playfield by a hollow cylinder having a base plate. In the FIG. 4 embodiment three coils are shown concentrically mounted around the cylinder to provide increased vertical acceleration to the ball. Disposed above the playfield 60, is a wire or plastic ramp or ball guide 70. The ball 64 both enters and leaves through this ball guide. The use of three coils is required because of the need to propel the ball a substantial distance above the playfield and onto to a ramp or other elevated ball carrying member. As with the FIG. 1 embodiment, separate sets of sensor elements are provided for each coil to maximize acceleration.

Figure 5A:
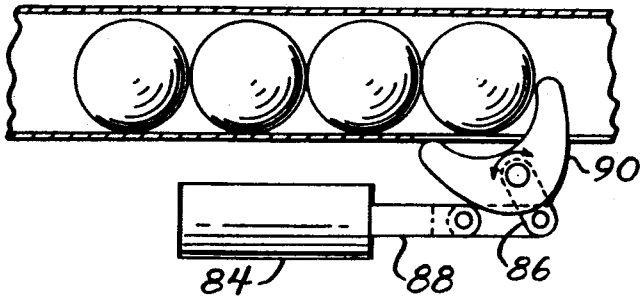
FIG. 5*a* is plan view of FIG. 5 showing the indexing mechanism.
Figure 5:
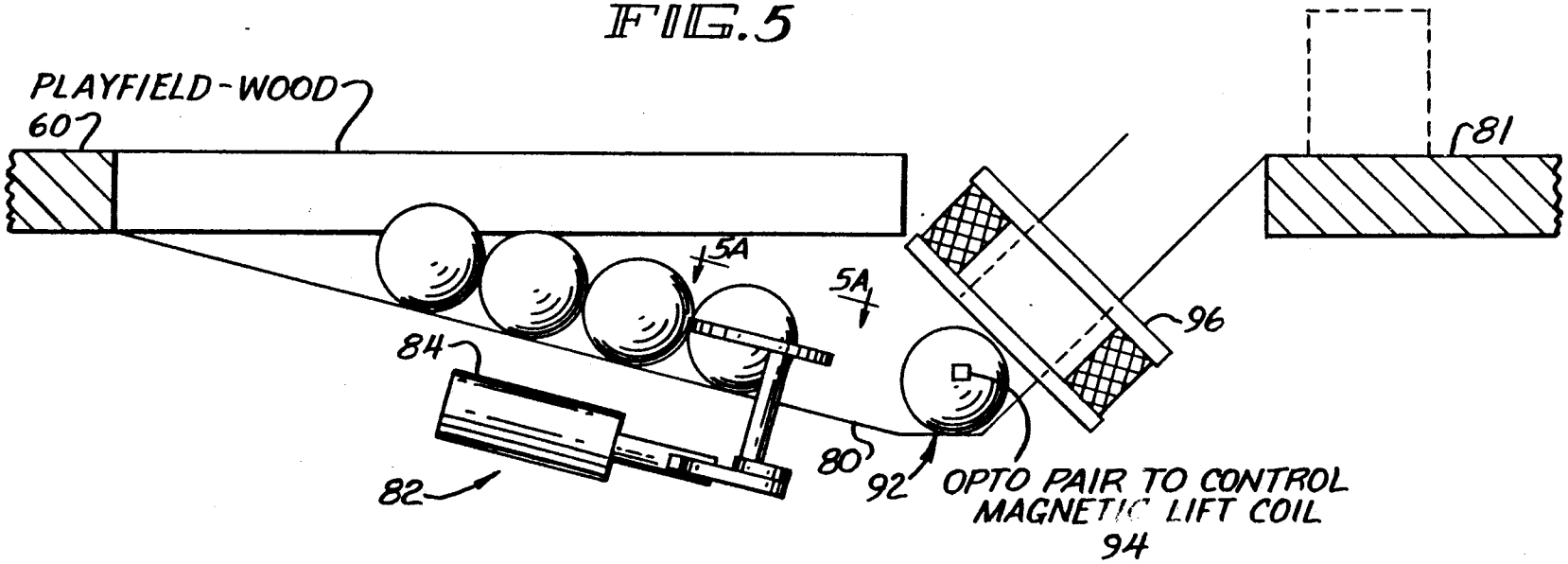
FIG. 5 illustrates a side sectional view of a further embodiment in which the invention is used to release balls from a storage trough and "tee it up" for the player to put a new ball into play.

Referring to FIG. 5, a further embodiment of the invention is illustrated. In a typical pinball game, when the ball eludes the player operated flippers, it enters a trough disposed beneath the playfield and the player's turn ends. Such a trough, shown at 80 in FIG. 5 can hold one or more pinballs when they are not needed for play in the game. To initiate game play or the next ball in a game, a ball is elevated from the trough onto an area of the playfield sometimes referred to as the shooter lane from which it may be struck by a player-operated plunger to propel it onto the main portion of the playfield. The present invention can be utilized for this purpose, replacing the traditional electro-mechanical apparatus which was subject to chronic problems, particularly as pinball games age. More specifically, the traditional device employed a solenoid ejector to kick the ball from the trough 80 into the shooter lane. In addition, an indexing mechanism is required to prevent more than one ball from accessing the ejector at a time. The present invention eliminates the need for a mechanical ejector although an indexing mechanism may still be employed, if desired.

Referring to FIG. 5, the playfield 60 has a trough 80 located adjacent to the shooter lane 81. As balls enter the trough they are captured by a one-at-a-time mechanism generally indicated at 82. As shown in the plan view of FIG. 5*a*, mechanism 82 includes a solenoid 84, a linkage 86 coupled to the solenoid piston 88 for reciprocating a claw-like element 90 between blocked and unblocked positions. This assembly is well known in the art. Each time the solenoid 84 is operated it will release one ball down the inclined surface of the trough to the position shown at 92 in FIG. 5. When the ball is released it will interrupt the sensor element path of sensor pair 94. When appropriate, the coil 96 is operated as described before, thereby to project it onto the shooter lane. It will be recognized that the operation of the coil can be inhibited as necessary, depending upon the stage of the game. For example, in a game over condition, the coil would be disabled to prevent further play.

Figure 6:
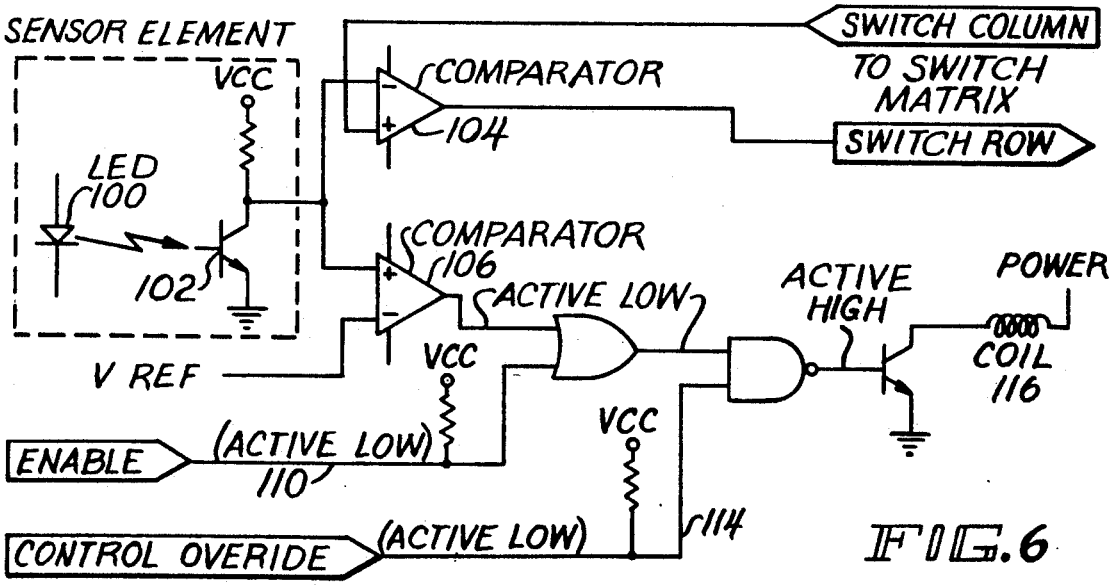
FIG. 6 is a schematic diagram illustrating typical circuitry for operating the ball accelerator according to the present invention.

Referring to FIG. 6, a schematic diagram is provided of a typical control circuit for the ball accelerator according to the present invention when used in connection with a typical rolling ball game. The circuit shown is duplicated for each coil used. In the preferred embodiment, the sensor elements are optical semi-conductors. Accordingly, there is illustrated an LED 100 which, in the absence of a pinball, provides a signal to the photo-detector transistor 102. In turn, this provides an output to comparitors 104 and 106. Comparitor 104 is connected in a switch matrix of the type typically employed in a micro-processor controlled rolling ball game to permit the processor to poll the status of various switches. In this way, the processor can determine the location of the ball and override operation of a particular coil if desired.

Comparitor 106 provides an output to OR gate 108. A second input to the OR gate is an enable signal on line 110 from the micro-processor system. It will be apparent to those skilled in the art that by changing the state of the enable line 110, it is possible to disable operation of a particular coil, for example, at the end of a game. The output of OR gate 108 is provided to a NAND gate 112 which receives as its second input a control override signal on line 114. Gate 112 permits operation of the coil under the direct control of the micro-processor via line 114. This permits operation of the coil, even if the sensors are disabled and is useful for testing or even computing control of the playfield utilizing an accelerator coil. The output of the NAND gate 112 is applied via a power transistor to the accelerator coil 116.

As indicated previously, in the acceleration embodiment (FIG. 2), current is normally applied to the coil when a rolling ball first interrupts the sensor elements prior to entering the coil. This initiates the current to the coil creating a magnetic field which draws the ball into the coil and thereby accelerates it. As soon as the ball has cleared the sensor elements, the logic signals change (the outputs of gates 108 and 112 change) discontinuing power to the coil ensuring that there will be no decelerating field to slow the ball as it completes its travel through the coil.

In those cases where it is desired to prevent immediate operation of a coil it is only necessary to change the signal on the enable line 110 thereby preventing the sensors from firing a coil. This is advantageously employed for the FIGS. 3–5 embodiments. Similarly, where it is desired to fire a coil independently of the sensors, it is only necessary to change the signal level on line 114.

From the foregoing, it will be seen that a very versatile game element has been disclosed which can add both player interest and extended life to a rolling ball game. Furthermore, it will be recognized that the use of a sensor to control each coil provides a variable duration current pulse which is a function of the entrance velocity of the ball. This automatically accommodates the mechanism for any ball velocity which it may encounter during the course of play.

While preferred embodiments of the present invention have been illustrated and described, it will be understood by those of ordinary skill in the art that changes and modifications can be made without departing from the invention in its broader aspects. Various features of the present invention are set forth in the following claims

What is claimed:

1. In a rolling ball game having a playfield on which a ball formed of magnetic material can roll, a playfield feature for accelerating the ball comprising:

a. at least one coil means, having an opening dimensioned to permit said ball to pass therethrough each of said coil means including a plurality of coils of electrically conducting wire for creating a magnetic field when an electric current is applied thereto;

b. sensor means for each coil means for detecting a ball at the entrance to said opening;

c. circuit means responsive to said sensor means, for initiating current flow to each of said coil means when a ball is detected at its entrance and for terminating said current flow when the sensor means no longer detects the ball at said entrance;

whereby a magnetic field is generated by each coil means to accelerate the ball as it passes therethrough, the duration of each field being a function of the velocity of the ball at the entrance to each opening, thereby to maximize acceleration.

2. The playfield feature of claim 1 wherein the width of the coil means is at least equal to the diameter of the ball to ensure that the current flow to said wire coils will terminate by the time the center of mass of the ball reaches the midpoint of a coil means.

3. The playfield feature according to claim 1 further including means for conveying the ball to, through and away from said coil means.

4. The playfield feature according to claim 3 wherein the conveying means is a ball ramp passing through said coil means on which said ball travels.

5. The playfield feature according to claim 4 wherein the feature includes at least two coil means and the ball ramp includes an arcuate portion conveying the ball from the last coil means back to the first coil means and further including means for diverting the ball from said arcuate portion to release the ball.

6. The playfield feature according to claim 1 wherein the coil means are oriented to accelerate the ball in a generally vertical direction and further including a support member on which the ball may rest prior to operation of the playfield feature.

7. The playfield feature according to claim 6, wherein the playfield includes an opening into which the ball may drop, said support member and said coil means being located below said playfield, operation of said playfield feature serving to project the ball back onto or above said playfield.

8. The playfield feature according to claim 7 wherein the playfield feature is a ball ejector having one coil means disposed below the playfield to project the ball onto the playfield.

9. The playfield feature according to claim 7 wherein the playfield feature is a ball popper having at least two coil means for projecting the ball above the surface of the playfield.

10. The playfield feature according to claim 9 further including means disposed above the playfield for receiving the ball projected by said ball popper.

11. The playfield feature according to claim 10 wherein said receiving means is a ramp.

12. The playfield feature according to claim 1 wherein said circuit means includes:

means for preventing operation of said coil means to inhibit game operation.

13. The playfield feature according to claim 1 wherein said circuit means includes means for operating said coil means irrespective of the output from the sensor means.

* * * * *